US005847917A

United States Patent [19]

Suzuki

[11] Patent Number: 5,847,917

[45] Date of Patent: Dec. 8, 1998

[54] AIR IONIZING APPARATUS AND METHOD

[75] Inventor: Masanori Suzuki, Tokyo, Japan

[73] Assignee: Techno Ryowa Co., Ltd., Tokyo, Japan

[21] Appl. No.: 539,321

[22] Filed: Oct. 4, 1995

[30] Foreign Application Priority Data

Jun. 29, 1995 [JP] Japan ..... 7-163230

[51] Int. Cl.[6] ..... H05F 3/06

[52] U.S. Cl. ..... 361/213

[58] Field of Search ..... 361/213, 225, 361/229, 230, 231

[56] References Cited

U.S. PATENT DOCUMENTS

| | | | |
|---|---|---|---|
| 4,333,123 | 6/1982 | Moulden | 361/213 |
| 5,095,400 | 3/1992 | Saito | 361/230 |
| 5,116,583 | 5/1992 | Batchelder et al. | 361/231 |

FOREIGN PATENT DOCUMENTS

| | | |
|---|---|---|
| 4223085 | 8/1992 | Japan . |
| 515508 | 3/1993 | Japan . |

*Primary Examiner*—Fritz M. Fleming
*Attorney, Agent, or Firm*—Price, Gess & Ubell

[57] ABSTRACT

In an air ionizing apparatus of a type utilizing a sheath gas not containing water (hydrogen) or impurities to sheathe corona electrodes, sufficient amount of ions are generated to fully eliminate static electricity from the interior of a production environment such as a clean room and to prevent the impurities from depositing on the corona electrodes. The tips of corona electrodes 21*a* and 21*b* are positioned inwardly of the tips of sheath gas nozzles 4*a* and 4*b*, respectively, by a certain distance. The distance is so determined that for a sheath gas containing no negative gaseous molecules, electrons emitted by corona discharge can reach air existing outside the sheath gas nozzle 4*b* and that for a sheath gas containing the negative gaseous molecules, negative ions emitted by corona discharge can rapidly disperse into the air outside the sheath gas nozzle 4*b* without remaining in the interior of the nozzle 4*b*.

18 Claims, 6 Drawing Sheets

AIR IONIZING APPARATUS AND METHOD

BACKGROUND OF THE INVENTION

1. Field of the Invention

The present invention relates generally to an air ionizer for generating ions to eliminate static electricity, and more particularly to an air ionizing apparatus and air ionizing method for preventing impurities from depositing on its electrodes.

2. Description of the Prior Art

It is well known that in a clean room for the manufacture of semiconductors that static can occur due to its low-humidity environment and due to the fact that plastic containers for carrying wafers and semiconductor chips are subject to being electrostatically charged. This static electricity may allow dust to adhere on surfaces of the wafers and may destroy the IC's or semiconductor chips resting on the wafers, resulting in poor yield. In addition, with recent progress toward high density semiconductor chips, an ultra-high cleanness level is desired for the clean room while simultaneously electrostatic resistance of the semiconductor chips is impaired, allowing such static electricity to bring about a serious obstacle to production.

Also in the production environments other than the clean room, the static electricity disadvantageously brings about various obstacles to production, for example, due to adhesion of dust onto products arising from its charge and due to electrostatic destruction and electric shock arising from its discharge.

Consequently, as a measure of eliminating static electricity in the production environment such as the clean room, use has been hitherto made of an air ionizing apparatus for neutralizing by ions the electric charges accumulated on the electrostatically charged body. In this air ionizing apparatus, positive or negative high-voltage is applied to its positive or negative needle-like electrode, respectively, to generate a corona discharge. Then, the air around the tips of the electrodes is positively or negatively ionized, and the resultant ions are carried by air flow so that the electric charges on the charged body are neutralized by the ions having the opposite polarity.

For the above air ionizing apparatus, however, the presence of water (hydrogen) in the air within the clean room allowed a very small amount of impurities to be generated by chemical reaction attendant on the corona discharge and to be deposited and built up on the corona electrodes. Alternately, impurities such as trace gas or such as ultrafine particles (e.g., substances containing Si element) existing in the air were coarse-grained and built up on the corona electrodes. Thus, there arose a problem that the built-up impurities again can be scattered in the clean room. For this reason, the vicinity of the corona electrode in the air ionizing apparatus is sheathed with a dry gas or a gas not containing impurities such as a trace gas to thereby prevent the impurities from depositing onto the tips of the corona electrode due to the discharge energy. It is to be noted that the gas for use in sheathing is called a sheath gas.

FIG. 7 illustrates a configuration of a corona air ionizing apparatus disclosed in Japanese Patent Laid-open Pub. No. 4-223085, as an example of the air ionizing apparatus whose corona electrodes are sheathed with the dry gas or a gas containing no impurities. In the diagram, positive and negative corona electrodes 21*a* and 21*b* are arranged within a casing 20. The corona electrodes 21*a* and 21*b* are made of pure tungsten and are connected to a high-voltage power source not shown to cause corona discharge for generating ions.

The surface of the casing 20 is covered with a tape 22 made of vinyl chloride resin. The surface covered with the tape 22 is provided with a couple of openings each having a diameter of 1 cm and confronting the corona electrodes 21*a* and 21*b*, respectively. Into the openings are inserted sleeves 23*a* and 23*b* having a length of 1 cm and made of TYGON (registered trademark) pipe 0.5 inch in diameter so as to prevent moisture- containing air from flowing into the vicinity of the corona electrodes 21*a* and 21*b* with the aid of turbulence. The sleeves 23*a* and 23*b* must be positioned apart from the discharge ranges of the corona electrodes 21*a*and 21*b* in order to prevent the formation of fine particles arising from corrosion of the sleeves 23*a* and 23*b*. Thus, the sleeves 23*a* and 23*b* are separated by 4 mm or over from the tips of the corona electrodes 21*a* and 21*b*, respectively.

Gas supply pipes 24*a* and 24*b* extend through the vicinity of the sleeves 23*a* and 23*b*, constantly allowing the dry gas or a gas not containing any impurities to flow into the interiors of the sleeves. The above gas supply pipes 24*a* and 24*b* are made of, e.g., TEFLON (registered trademark) and are fitted with a high-performance in-line filter not shown.

However, the air ionizing apparatus as shown in FIG. 7 entailed a deficiency that negative ions are difficult to generate since the sleeves 23*a* and 23*b* are positioned apart from the discharge ranges of the corona electrodes 21*a* and 21*b*, respectively, as described above. The grounds therefor will now be given on the case using a high-purity $N_2$ gas as the sheath gas.

Table 1 shows first excitation potential and ionization potential of various gases, and Table 2 shows electron affinity of various atoms ("Handbook on Electrostatics" edited by Electrostatic Society, Ohm Co., Ltd., 1985).

TABLE 1

| GAS | EXCITATION POT.*1 | IONIZATION POT. | METASTABLE POT. | |
|---|---|---|---|---|
| H | 10.2 | 13.6 | — | — |
| He | 19.8 | 24.6 | 20.62 | 20.96 |
| Ne | 16.5 | 21.6 | 16.62 | 16.72 |
| Ar | 11.6 | 15.8 | 11.53 | 11.72 |
| Na | 2.11 | 5.14 | — | — |
| K | 1.61 | 4.34 | — | — |
| Cs | 1.38 | 3.89 | — | — |
| Hg | 4.89 | 10.4 | 4.67 | 5.47 |
| $H_2$ | 11.5 | 11.5 | — | — |
| $N_2$ | 5.23 | 15.6 | 8.2 | 9.77 |
| $O_2$ | 1.64 | 12.2 | — | — |
| $SF_6$ | — | 15.8*2 | — | — |

*1minimum excluding metastable potential

*2case of $SF_6 \rightarrow SF_5{}^{+}F + e$

TABLE 2

| ATOM | ELECTRON AFFINITY [eV] |
|---|---|
| F | 3.94 |
| Cl | 3.70 |
| Br | 3.54 |
| I | 3.22 |
| O | 3.80 |
| $O_2$ | 1.0 |
| S | 2.06 |
| Hg | 1.79 |
| C | 1.37 |
| H | 0.76 |
| Li | 0.34 |
| N | 0.04 |
| Na | 0.08 |

The ionization potential means an energy required for being positively ionized by the emission of electrons, and the electron affinity means an energy emitted when being negatively ionized by the bond with electrons. As seen in Table 1, there is no significant difference in the ionization potential between pure $N_2$ and oxygen ($O_2$), both readily turning to positive ions. On the contrary, as is apparent from Table 2, the atom of $N_2$ (N atom) has extremely small electron affinity and hardly has a tendency to turn to negative ions.

Description will now be given of a mechanism generating negative ions. Although it has not yet been confirmed experimentally, the mechanism of the negative ion generation is supposed to be as follows from the facts already proved. FIG. 8 illustrates the mechanism of a discharge at the negative electrode.

When a predetermined or more high-voltage is first applied to the negative electrode, electrons within the electrode are emitted to the exterior of the electrode by quantum-mechanical tunnel effect (field emission). The electrons thus emitted and accelerated by the electric field collide with neutral gaseous molecules existing in the vicinity of the electrode and ionize those molecules (ionization by collision). At that time, electrons newly struck out further ionize other neutral gaseous molecules to cause an electron avalanche.

If the electrode is disposed within a gas containing electrically negative molecules such as $O_2$, a group of electrons thus generated will electronically attach to the negative gaseous molecules, turning to negative ions. Then, the electron avalanche comes to a stop in the vicinity of the electrode, in other words, the ionization area. However, if the electrode is disposed within the high-purity $N_2$ gas, the group of electrons are not permitted to turn to negative ions due to the absence of negative gaseous molecules such as $O_2$.

Accordingly, in the case where the corona electrodes are positioned deeply in the interiors of the nozzles filled with the high-purity $N_2$ gas as the air ionizing apparatus shown in FIG. 7, it is difficult for the generated electrons to reach the exteriors of the nozzles. That is, in the case of using a gas not containing any negative gaseous molecules such as high-purity $N_2$ in the air ionizing apparatus as shown in FIG. 7, it was hard for negative ions to be generated.

On the contrary, in the case of using air as the sheath gas in place of the high-purity $N_2$ gas, ions generated in a limited space such as the interior of the nozzle do not rapidly disperse but remain within the limited space to cover the corona electrode. For this reason, the electric field strength at the tip of the corona electrode lowers to prevent a corona electrode from emitting electrons, resulting in no generation of ions. That is, in the same manner as the case of $N_2$ gas, if the corona electrodes are positioned deeply in the interiors of the nozzles as the air ionizing apparatus shown in FIG. 7, it would be difficult for the negative ions to be generated. Although it is conceivable to supply a high-velocity sheath gas to blow away the remaining negative ions to the exterior, it is not desirable since a large amount of sheath gas is consumed and upon using in the clean room the unidirectional flow is disturbed.

SUMMARY OF THE INVENTION

The present invention was conceived to overcome the above problems. It is therefore the object of the present invention to generate a sufficient amount of negative ions to thereby fully eliminate static electricity from the interior of a production environment such as a clean room and to sheathe an electrode with a sheath gas not containing impurities or water (hydrogen) to thereby prevent the impurities from depositing on the electrode.

According to a first aspect of the present invention, there is provided an air ionizing apparatus for generating positive or negative ions to eliminate static electricity, the apparatus comprising a pair of nozzles; a pair of needle-like corona electrodes respectively inserted into the interiors of the pair of nozzles associated therewith; positive and negative high-voltage power sources respectively connected to the pair of corona electrodes for generating corona discharge; and gas supply means for supplying a sheath gas into the interiors of the nozzles and causing the sheath gas to pass through the vicinity of the corona electrodes and flow out through the tips of the nozzles to the exteriors; the corona electrodes being positioned within the associated nozzles in such a manner that the tips of the corona electrodes are retreated inwardly from the tips of the associated nozzles by a predetermined distance; the predetermined distance by which the tips of the corona electrodes are retreated from the tips of the associated nozzles is set at such a value that in the case of using as the sheath gas a gas containing no negative gaseous molecules, electrons emitted by the corona discharge and sent forth together with the sheath gas from the nozzle tips can reach air existing outside the nozzles.

According to a second aspect of the present invention, there is provided an air ionizing apparatus for generating positive or negative ions to eliminate static electricity, the apparatus comprising a pair of nozzles; a pair of needle-like corona electrodes respectively inserted into the interiors of the pair of nozzles associated therewith; positive and negative high-voltage power sources respectively connected to the pair of corona electrodes for generating corona discharge; and gas supply means for supplying a sheath gas into the interiors of the nozzles and causing the sheath gas to pass through the vicinity of the corona electrodes and flow out through the tips of the nozzles to the exteriors; the corona electrodes being positioned within the associated nozzles in such a manner that the tips of the corona electrodes are retreated inwardly from the tips of the associated nozzles by a predetermined distance; the predetermined distance by which the tips of the corona electrodes are retreated from the tips of the associated nozzles is set at such a value that in the case of using as the sheath gas a gas containing negative gaseous molecules, negative ions emitted by the corona discharge can rapidly disperse into the air existing outside the nozzles without remaining in the nozzles.

According to a third aspect of the present invention, there is provided an air ionizing apparatus for generating positive or negative ions to eliminate static electricity, the apparatus comprising a pair of nozzles; a pair of needle-like corona electrodes respectively inserted into the interiors of the pair of nozzles associated therewith; positive and negative high-voltage power sources respectively connected to the pair of corona electrodes for generating corona discharge; and gas supply means for supplying a sheath gas into the interiors of the nozzles and causing the sheath gas to pass through the vicinity of the corona electrodes and flow out through the tips of the nozzles to the exteriors; the corona electrodes being positioned within the associated nozzles in such a manner that the tips of the corona electrodes are retreated from the tips of the associated nozzles by a predetermined distance; the predetermined distance by which the tips of the corona electrodes are retreated inwardly from the tips of the associated nozzles is set at 1 mm or less.

Preferably, the sheath gas is an inert gas. The velocity of the sheath gas is so determined that gas flow is engulfed into said nozzles in the vicinity of the tips of the nozzles. The velocity of the sheath gas is preferably 1.0 m/sec. or over.

According to a fourth aspect of the present invention, there is provided an air ionizing method for generating positive or negative ions to eliminate static electricity, the method comprising the steps of inserting a pair of needle-like corona electrodes respectively into the interiors of a pair of nozzles associated therewith, the pair of corona electrodes being respectively connected to positive and negative high-voltage power sources; positioning the corona electrodes within the interiors of the associated nozzles in such a manner that the tips of the corona electrodes are retreated inwardly from the tips of the associated nozzles by a predetermined distance and in such a manner that when the sheath gas is a gas containing no negative gaseous molecules, the tips of the corona electrodes lie in close proximity to the tips of the associated nozzles so that electrons emitted by the corona discharge can reach air existing outside the nozzles; supplying the sheath gas into the interiors of the nozzles and allowing the sheath gas to pass through the vicinity of the corona electrodes and flow out from the tip of the nozzles to the exteriors; and causing the sheath gas to send forth ions generated at the corona electrodes into the air existing outside the nozzles.

According to a fifth aspect of the present invention, there is provided an air ionizing method for generating positive or negative ions to eliminate static electricity, the method comprising the steps of inserting a pair of needle-like corona electrodes respectively into the interiors of a pair of nozzles associated therewith, the pair corona electrodes being respectively connected to positive and negative high-voltage power sources; positioning the corona electrodes within the interiors of the associated nozzles in such a manner that the tip of the corona electrodes are retreated inwardly from the tips of the associated nozzles by a predetermined distance and in such a manner that when the sheath gas is a gas containing negative gaseous molecules, the tips of the corona electrodes lie in close proximity to the tips of the associated nozzle so that negative ions emitted by the corona discharge can rapidly disperse into the air existing outside the nozzles without remaining in the interiors of the nozzles; supplying the sheath gas into the interiors of the nozzles and allowing the sheath gas to pass through the vicinity of the corona electrodes and flow out from the tips of the nozzles to the exteriors; and causing the sheath gas to send forth ions generated at the corona electrodes into the air existing outside the nozzles.

According to a sixth aspect of the present invention, there is provided an air ionizing method for generating positive or negative ions to eliminate static electricity, the method comprising the steps of inserting a pair of needle-like corona electrodes respectively into the interiors of a pair of nozzles associated therewith, the pair of corona electrodes being respectively connected to positive and negative high-voltage power sources; positioning the corona electrodes within the interior of the associated nozzles in such a manner that the tips of the corona electrodes are retreated inwardly from the tips of the associated nozzles by a predetermined distance and in such a manner that the predetermined distance by which the tips of the corona electrodes are retreated inwardly from the associated tips of the nozzles is 1 mm or less; supplying a sheath gas into the interiors of the nozzles and allowing the sheath gas to pass through the vicinity of the corona electrodes and flow out from the tips of the nozzles to the exteriors; and causing the sheath gas to send forth ions generated at the corona electrodes into the air existing outside the nozzles.

The present invention having the above configuration functions as follows. According to the first or fourth aspect of the present invention, the high-voltage power source applies a high voltage to the positive and negative corona electrodes, to generate corona discharge. In the vicinity of the positive corona electrode, the sheath gas therearound is positively ionized by the corona discharge and is carried to the exterior of the nozzle. In the vicinity of the negative corona electrode, on the other hand, no negative ions appear since there are no negative gaseous molecules to which are electronically attached a group of electrons generated by the corona discharge. However, these electrons are carried to the exterior of the nozzle along with the sheath gas, so that they are attached to negative gaseous molecules such as oxygen existing in the air, resulting in negative ions.

At that time, the tip of the corona electrode is sheathed with the sheath gas not containing impurities such as trace gas or water without protruding from the tip of the nozzle to the exterior, thus preventing the corona discharge from causing deposition of the impurities. The distance from the tip of the corona electrode to the tip of the nozzle is so determined that the group of electrons can span this distance. This will eliminate the deficiency that due to the greater distance from the tip of the electrode to the tip of the nozzle as the air ionizer shown in FIG. 7, a group of electrons generated in the vicinity of the corona electrode can not reach the exterior of the nozzle and hence the negative ions are hard to generate.

According to the second or fifth aspect of the present invention, negative ions are also generated in the vicinity of negative corona electrode, the negative ions thus generated being discharged to the exterior. Although in the air ionizer as shown in FIG. 7 it was difficult to discharge to the outside the ions which are generated in a narrow space such as the interior of the nozzle and tend to remain therewithin, the negative ions generated in the present invention are rapidly dispersed and discharged to the exterior due to its lesser distance from the tip of the corona electrode to the tip of the nozzle.

According to the third aspect of the present invention, upon the use of a gas containing no negative gaseous molecules as the sheath gas, a group of electrons generated by the corona discharge are carried together with the sheath gas to the exterior of the nozzle, whereas upon the use of a gas containing a negative gaseous molecule containing gas, the ions generated by the corona discharge are discharged intactly to the outside.

Used as the sheath gas for preventing deposition of impurities onto the corona electrode is an inert gas which can be, e.g., a high-purity nitrogen gas. Since the high-purity nitrogen gas is consumed in quantity within, e.g. a clean room for the manufacture of semiconductors as described earlier, it is widely handled as a general industrial gas and is supplied at relatively low price on a factory scale.

In the conventional air ionizer as shown in FIG. 7, due to a greater distance from the tip of the corona electrode to the tip of the nozzle, a group of electrons generated in the vicinity of the corona electrode did not reach the exterior of the nozzles, resulting in insufficient generation of negative ions. For this reason, the use of the high-purity nitrogen gas as the sheath gas made it difficult to generate a sufficient amount of negative ions. Thus, due to its lesser distance, the air ionizing apparatus of the present invention will ensure a generation of a sufficient amount of negative ions irrespective of the use of the gas containing no negative gaseous molecules as the sheath gas.

When a high-voltage is applied to the corona electrode, an ion wind is generated at the tip of the corona electrode, allowing the nozzle to issue a jet. At that time, if the velocity of the sheath gas velocity is low, a flow engulfment will appear in the vicinity of the tip of the nozzle due to induction flow caused by the jet. Thus, with the velocity of the sheath gas velocity not permitting the flow engulfment, it is possible to obtain a sufficient sealing effect and effectively prevent the impurities from depositing onto the corona electrode.

BRIEF DESCRIPTION OF THE DRAWINGS

These and other objects and advantages of the invention will become more apparent from the following detailed description when taken in conjunction with the accompanying drawings, in which.

DESCRIPTION OF THE PREFERRED EMBODIMENTS

Exemplary embodiments of an air ionizing apparatus of the present invention will now be described with reference to the accompanying drawings.

(1) Configuration of the Embodiment

Figure 1:
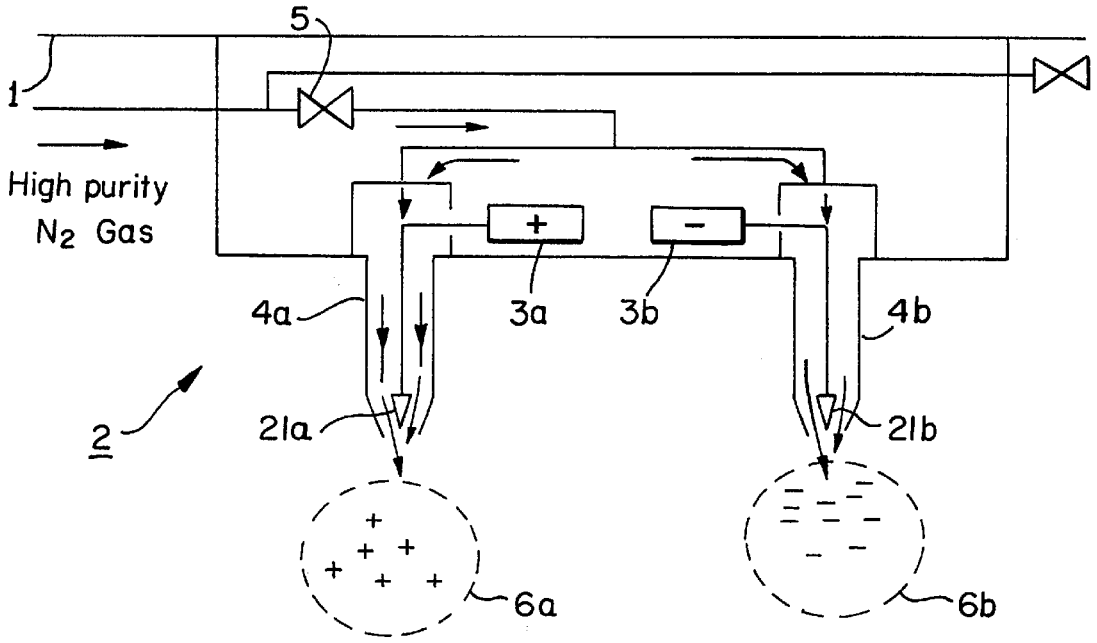
FIG. 1 is a schematic view depicting a configuration of an air ionizing apparatus according to an embodiment of the present invention.
Figure 7:
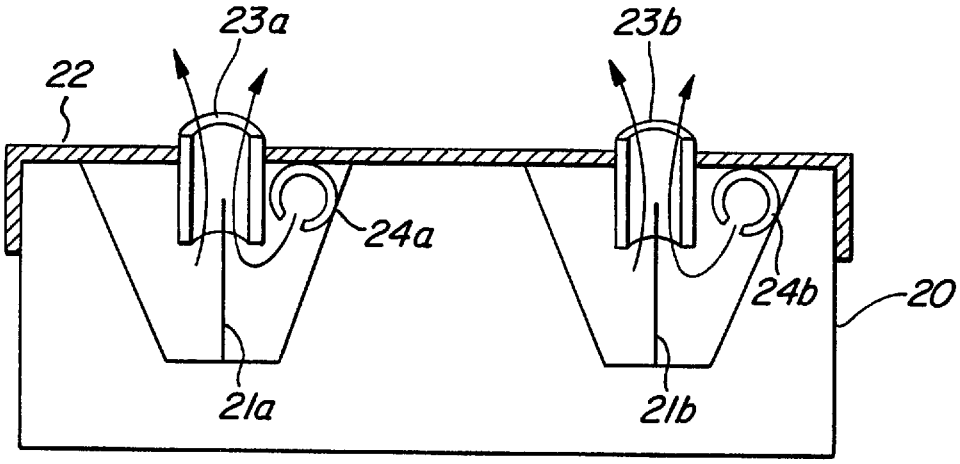
FIG. 7 PRIOR ART
FIG. 7 is a schematic view depicting a prior art configuration of a conventional air ionizing apparatus.
Figure 8:
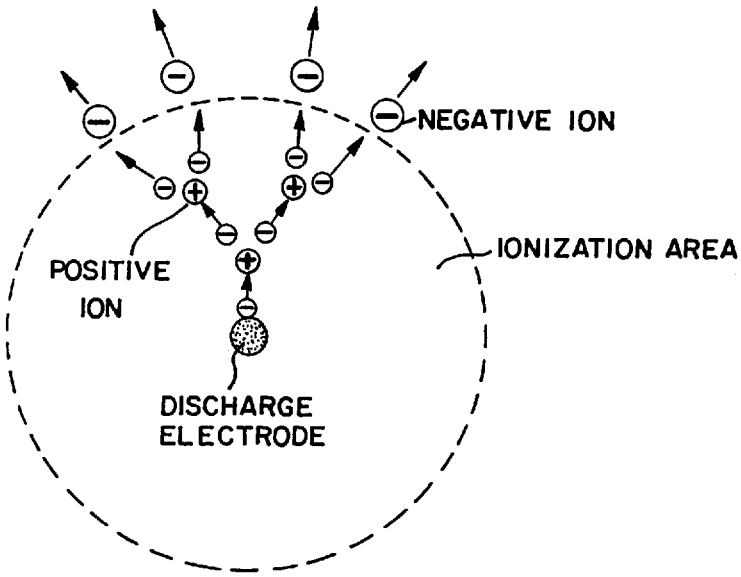
FIG. 8 is a conceptional diagram depicting a discharge mechanism in a negative electrode.

FIG. 1 schematically illustrates a configuration of the air ionizing apparatus according to an embodiment of the present invention. As shown, on the ceiling of a clean room are mounted a ULPA (Ultra Low Penetration air) filter 1 which is a high-performance filter for feeding clean air, and an air ionizing apparatus generally designated at 2. The air ionizing apparatus 2 comprises positive and negative corona electrodes 21*a* and 21*b* analogous to those depicted in FIG. 7. The corona electrodes 21*a* and 21*b* are respectively connected to DC pulse power sources 3*a* and 3*b*.

The air ionizing apparatus 2 further comprises downwardly extending sheath gas nozzles 4*a* and 4*b* within which the corona electrodes 21*a* and 21*b* are respectively arranged. High-purity $N_2$ gas acting as a sheath gas is fed via a valve 5 into the sheath gas nozzles 4*a* and 4*b*. The high-purity $N_2$ gas is an $N_2$ gas for use in, e.g., semi-conductor manufacturing processes, and is supplied through a piping not shown.

<Configuration of Sheath Gas Nozzle 4>

Figure 2A:
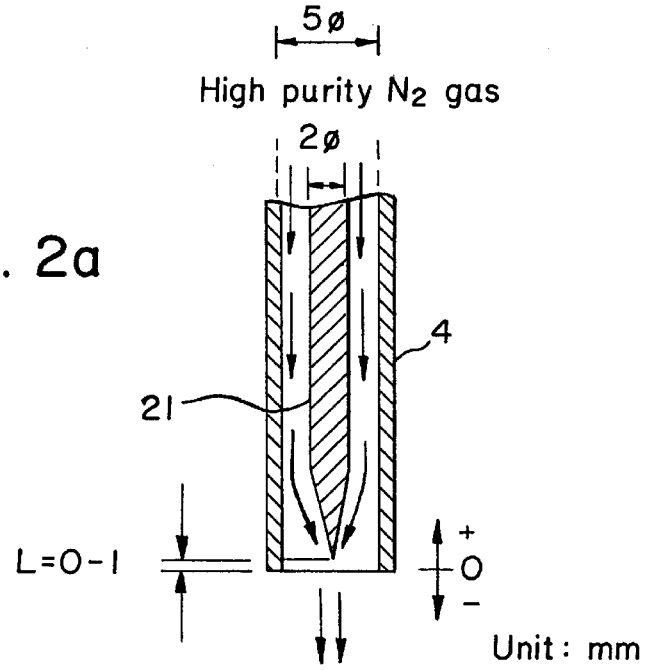
FIGS. 2(*a*) and 2(*b*) are longitudinal sectional view and cross-sectional view, respectively, depicting a configuration of a sheath gas nozzle 4 according to the embodiment.
Figure 2B:
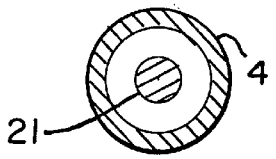

FIGS. 2(*a*) and 2(*b*) illustrate the configuration of the sheath gas nozzle 4 in longitudinal section and in cross section, respectively. In these diagrams, the sheath gas nozzle 4 has an internal diameter of 5 mm, and the corona electrode 21 has an external diameter of 2 mm. The distance L from the tip of the sheath gas nozzle 4 to the tip of the corona electrode 21 is 1.0 mm or less.

(2) Function of the Embodiment

In the air ionizing apparatus thus configured, the high-purity $N_2$ gas fed via the valve 5 is delivered to the vicinity of the corona electrodes 21*a* and 21*b*. A high voltage is applied to the corona electrodes 21*a* and 21*b* by the associated positive and negative DC pulse power sources 3*a* and 3*b*, respectively, to generate a corona discharge. As a result of this, in the sheath gas nozzle 4*a*, the high-purity $N_2$ gas around the corona electrode 21 is positively ionized, the resultant positive ions 6*a* being carried by the high-purity $N_2$ gas to the outside of the sheath gas nozzle 4*a*. That is, as shown in FIG. 2(*a*), the high-purity $N_2$ gas enters the sheath gas nozzle 4 from above, flows in the direction of the arrows, and leaves the sheath gas nozzle 4 through its lower end.

In the sheath gas nozzle 4*b*, on the other hand, a group of electrons generated near the tip of the corona electrode 21*b* are carried to the exterior of the sheath gas nozzle 4*b* by the high-purity $N_2$ gas, to be attached to rendering them negative gaseous molecules such as $O_2$ existing in the air within the clean room, and negatively ionized (negative ions 6*b*). The positive ions 6*a* and negative ions 6*b* are then carried toward the bottom of the clean room by the action of a vertically unidirectional flow from the ULPA filter 1.

(3) Experiment on Sheath Gas Nozzle 4

On the basis of the results of experiment, description will now be given of the grounds to set as shown in FIG. 2 the internal diameter of the sheath gas nozzle 4, the external diameter of the corona electrode 21, as well as the distance L from the tip of the corona electrode 21 to the tip of the sheath gas nozzle 4.

<Outline of Experiment>

Figure 3:
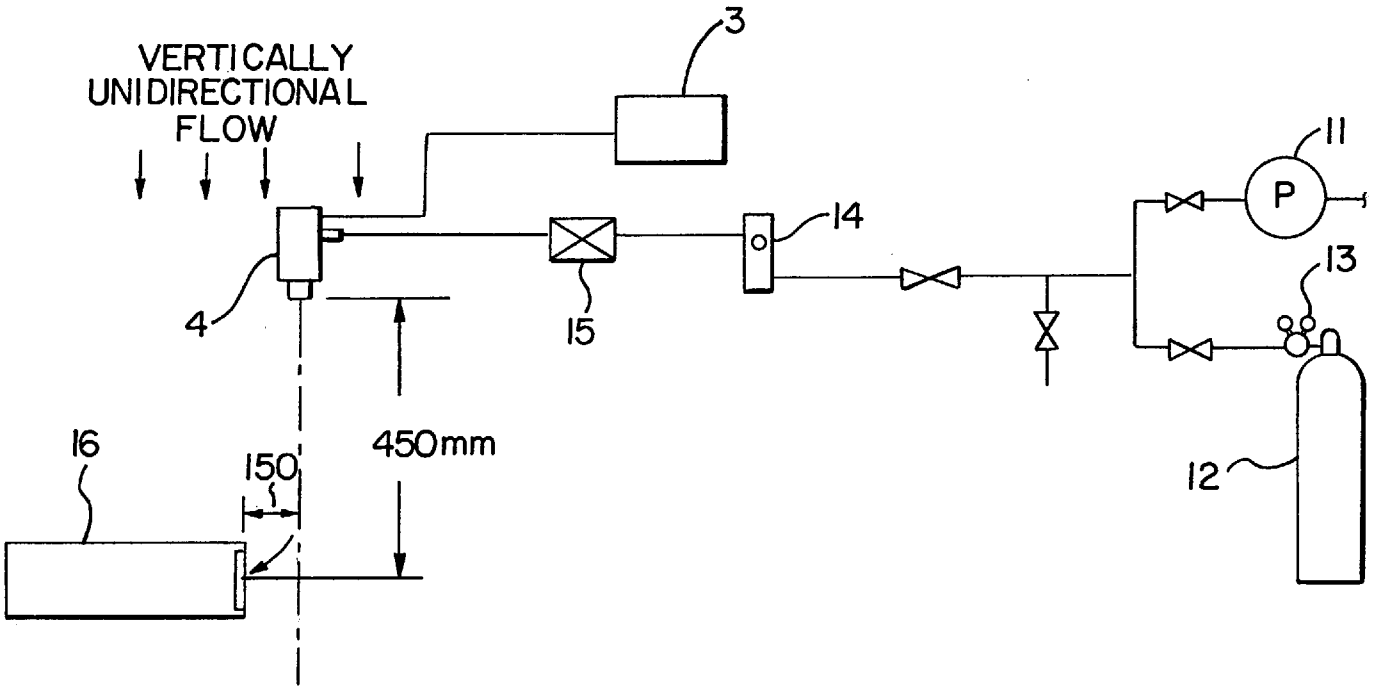
FIG. 3 is a schematic representation depicting a configuration of an experimental system associated with the sheath gas nozzle 4 according to the embodiment.

This experiment will now be outlined. FIG. 3 schematically illustrates an apparatus for carrying out the experiment on the sheath gas nozzle 4. As shown in this diagram, the positive and negative sheath gas for the nozzles 4*a* and 4*b* of the air ionizing apparatus are arranged in the unidirectional flow (0.3 m/sec.) within a vertically unidirectional flow (uniform laminar flow) type clean room (cleanness: 0.02 $\mu$m,class 1). It is to be noted that FIG. 3 depicts by reference numeral 4 only one of the positive and negative sheath gas nozzles 4*a* and 4*b*.

It is also to be appreciated that the experimental apparatus depicted in FIG. 3 does not include a dust collector or the like for removing impurities in the air since this experiment is intended for ionization of the air or high-purity $N_2$ gas within the sheath gas nozzle 4.

The sheath gas nozzle 4 is connected to the high-voltage DC pulse power source 3 whose on/off time is 0.4 seconds. A gas piping made of a vinyl tube is provided for the sheath gas nozzle 4. In the case of using air as the sheath gas, an air pump 11 is used to pump the air within the clean room for the supply to the sheath gas nozzle 4. In the case of using high-purity $N_2$ gas (purity: 99.995% or over) as the sheath gas, a pressure reducing valve 13 is used to reduce the pressure of the $N_2$ gas within a high-purity $N_2$ gas bomb 12 for the supply to the sheath gas nozzle 4. The sheath gas is regulated to have a flow rate of 2.0 l/min. (1.0 l/min. for each of the sheath gas nozzles) by a flowmeter 14 and is filtered by a membrane filter 15. The membrane filter 15 has a collection efficiency of 99.999% or over at 0.05 $\mu$m.

Also disposed below the sheath gas nozzle 4 is an ion counter (model AIDM115) 16 manufactured by U.S.Ion Systems Co., Ltd., which samples by suction the air within the clean room at 450 mm immediately below the tip of the sheath gas nozzle 4 and measures the ion concentration of the air sampled. When measuring the positive ion concentration by use of the ion counter 16, the output of the negative pole is minimized, whereas upon the measurement of the negative ion concentration, the output of the positive pole is minimized. More specifically, for the positive ion measurement, the voltage applied to the positive pole is 4.0 kV and the voltage applied to the negative pole is 3.0 kV. For the negative ion measurement, the voltage applied to the positive pole is 3.2 kV and the voltage applied to the negative pole is 6.8 kV.

<Results of Experiment>

The results of the thus configured experiment will be described. The grounds to set the distance L shown in FIG. 2 to be 1.0 mm or less will be first explained.

Figure 4:
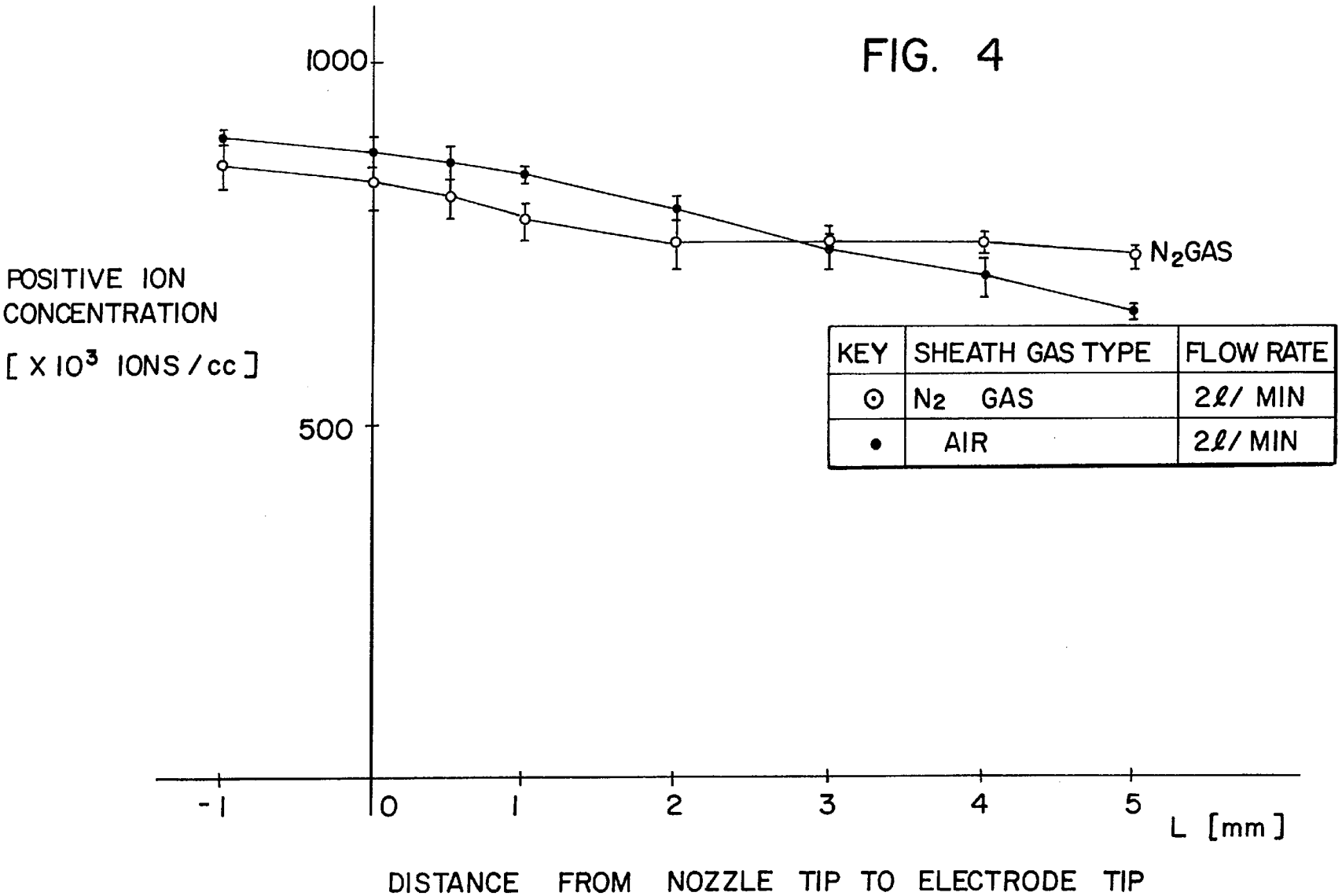
FIG. 4 is a graphic representation depicting the relationship between the positive ion concentration and the distance L, which is derived from the result of the experiment using the experimental system shown in FIG. 3.

FIG. 4 represents a relationship between the concentration of positive ions and the distance L both in the case of using $N_2$ gas as the sheath gas and in the case of using air. As is apparent from the graph, for the $N_2$ gas, any significant decrease in the ion concentration is not seen within the range of distance L from −1.0 mm to 5.0 mm although the ion concentration slightly reduces accordingly as the distance L becomes larger. Also for the air, substantially the same results were obtained as the case of using $N_2$ gas.

Figure 5:
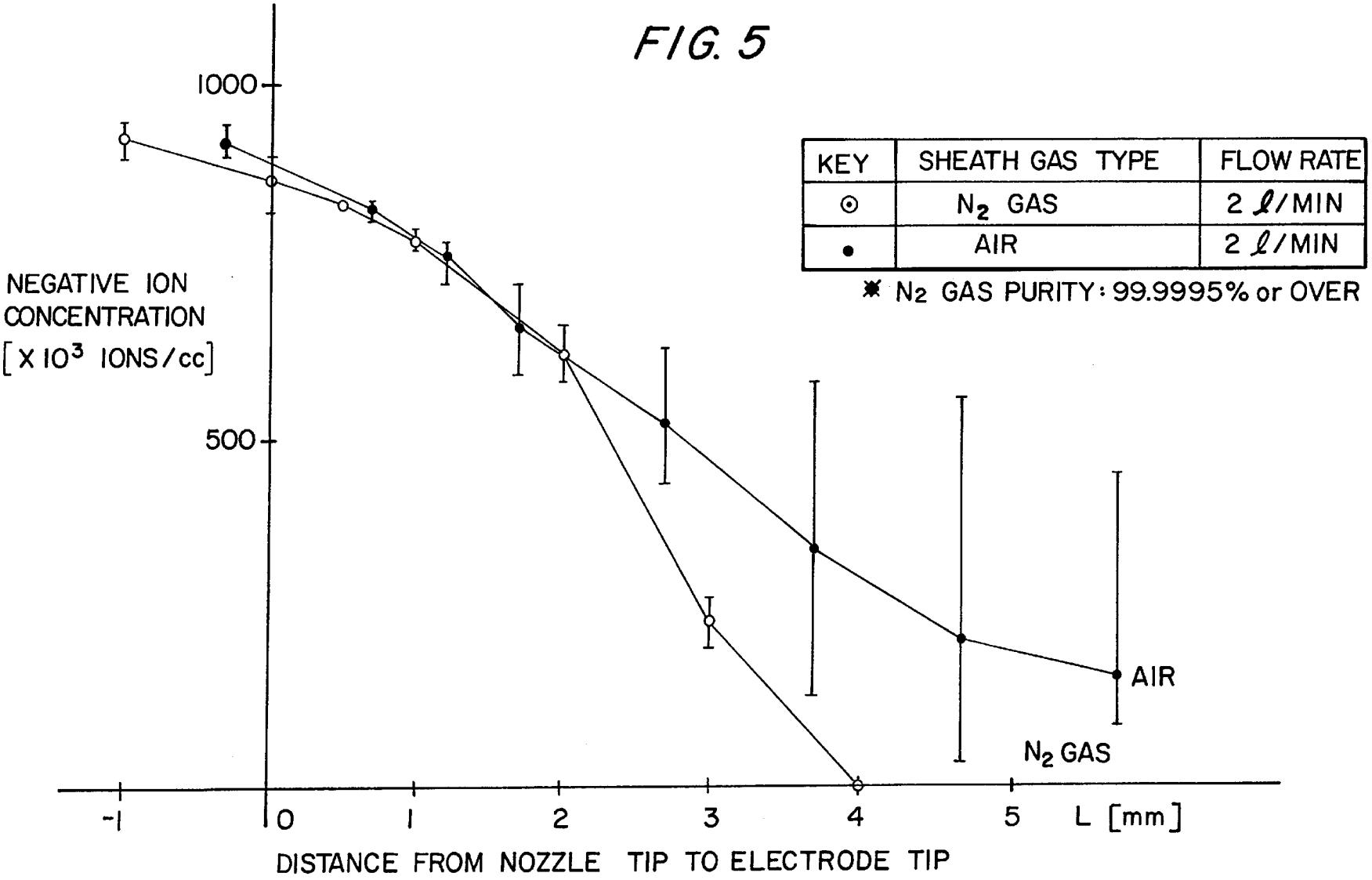
FIG. 5 is graphic representation depicting the relationship between the negative ion concentration and the distance L, which is derived from the result of the experiment using the experimental system shown in FIG. 3.

FIG. 5 represents a relationship between the concentration of negative ions and the distance L both in the cases of using air as the sheath gas and in the case of using $N_2$ gas. For the $N_2$ gas, the negative ion concentration sharply reduces when the distance L exceeds 1.0 mm and no ion generation is seen when the distance L reaches 4.0 mm. For the air, some ion generation is seen even though the distance L exceeds 4 mm, but the negative ion concentration becomes unstable when the distance L exceeds 3 mm. It will be understood from the graph of FIG. 5 that for both the $N_2$ gas and air, the smaller the value of the distance L, the higher the concentration of negative ions is, ensuring good ion generation. However, in order to provide a sealing effect by the sheath gas, it is preferred that the tip of the corona electrode 21 be apart farther from the air outside the sheath gas nozzle and hence the distance L be larger.

It can be seen from the above that in the case of using $N_2$ gas as the sheath gas, the distance should be not less than 0.0 mm and not more than 1.0 mm particularly in view of both the ion generation and the sealing effect by the sheath gas. Also in the case of using air, it is preferable that the value of the distance L be smaller to ensure a good generation of negative ions. Similarly, for the generation of positive ions, a smaller value of the distance L will result in a better ion generation. Thus, the value of the distance L should be 1.0 mm or less.

Explanation will be given of the grounds to set the internal diameter of the sheath gas nozzle 4 and the external diameter of the corona electrode 21 to be 5 mm and 2 mm, respectively, as shown in FIG. 2

Instead of increasing the value of the distance L, for example, the internal diameter of the sheath gas nozzle 4 may be increased, but it is uneconomical due to the consumption of a large amount of sheath gas. The grounds for internal diameter of the sheath gas nozzle 4 and the external diameter of the corona electrode 21 being 5 mm and 2 mm, respectively, in this experiment are to enhance the sealing effect of sheath gas by minimizing the sheath gas flow rate as well as possible and increasing the sheath gas flow velocity.

Figure 6A:
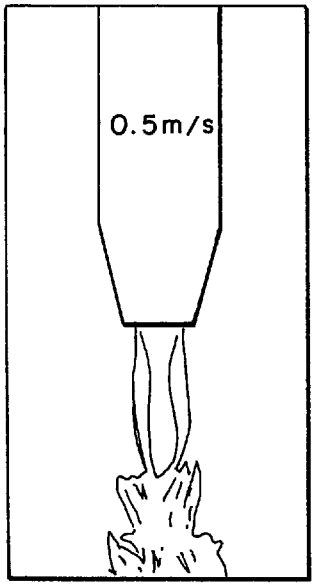
FIGS. 6A, 6B, 6C, 6D, 6E, and 6F are diagrams visualizing the sheath gas flow from the sheath gas nozzle 4.
Figure 6B:
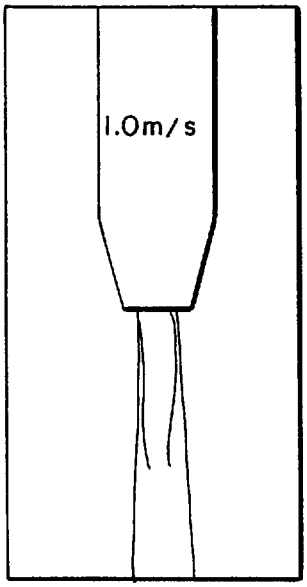
Figure 6C:
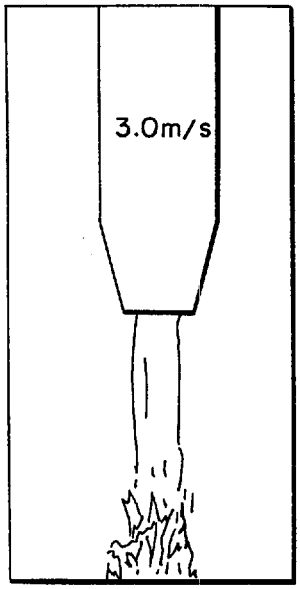
Figure 6D:
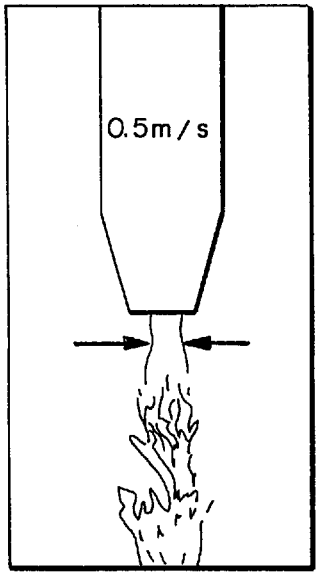
Figure 6E:
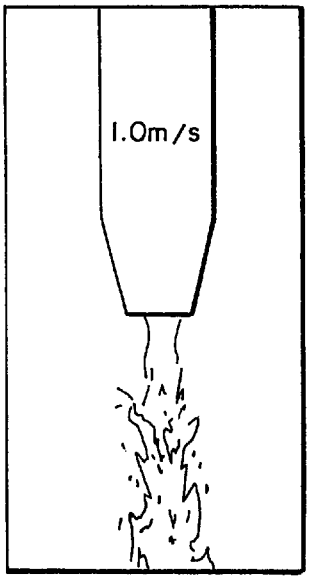
Figure 6F:
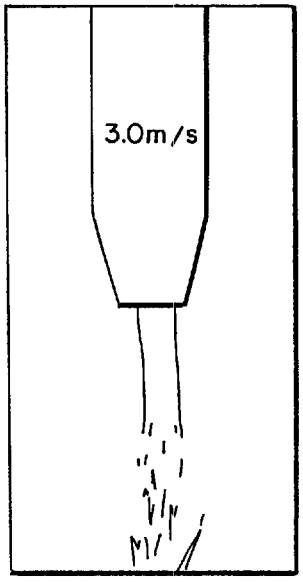

Referring to FIGS. 6A, 6B, 6C, 6D, 6E, and 6F there is visualized the flow of sheath gas from the sheath gas nozzle 4, with the 5 mm internal diameter sheath gas nozzle 4 and with the 2 mm external diameter corona electrode 21. FIG. 6A, 6B, and 6C depicts the case where the air ionizing apparatus is deenergized, whereas FIG. 6D, 6E, and 6F depicts the case where the air ionizing apparatus is energized. These diagrams bear the velocity of the sheath gas, that is, the sectional velocity of the sheath gas in a coaxially extending annular flow path defined by the inner wall of the sheath gas nozzle 4 and the outer wall of the corona electrode 21. In this case, air is employed as the sheath gas and the flow velocity of the vertically unidirectional flow around the sheath gas nozzle 4 is 0. 24 m/sec.

When a high voltage (+19 kV DC 1 Hz in FIG. 6) is applied to the corona electrode 21 within the sheath gas nozzle 4, an ion wind of several meters per second is generated at the tip of the corona electrode 21, and a jet emerges from the sheath gas nozzle 4. With a low sheath gas velocity, due to an induction flow generated by that jet, a flow is engulfed into the sheath gas nozzle 4 at the tip of that nozzle 4. If the sheath gas velocity shown in FIG. 6(*a*) is 0.5 m/sec.(0.5 l/min in terms of flow rate), the flow from the sheath gas nozzle 4 will include a slightly narrowed part as indicated by arrows in FIG. 6(*b*). This means insufficient sealing effect by the sheath gas.

If the sheath gas velocity exceeds 1.0 m/sec.(1.0 l/min. in terms of flow rate), the flow will include no narrowed part. Thus, it is found that the sheath gas velocity required for ensuring the sufficient sealing effect is 0.5 to 1.0 m/sec. or over, and more practically, not less than 1.0 m/sec.

From the foregoing, a desired sheath gas velocity can be obtained by setting the internal diameter of the sheath gas nozzle 4 and the external diameter of the corona electrode 21 to be 5 mm and 2 mm, respectively.

(4) Effect of the Embodiment

According to this embodiment, as described above, the distance L from the tip of the corona electrode 21 to the tip of the sheath gas nozzle 4 is set at 1 mm or less, whereupon regardless of use as a sheath gas of the $N_2$ gas containing no negative gaseous molecules, a group of electrons generated by corona discharge can freely move and jump out of the sheath gas. On the contrary, use of air as the sheath gas would allow negative ions generated by corona discharge to sheath the corona discharge electrodes and to disperse without weakening its electric field and finally to be discharged to the outside of the nozzle 4. This will enable the negative ions to be fully produced.

(5) Other Embodiments

It is to be appreciated that the present invention is not intended to be limited to the above embodiment, but can be variously modified without departing from its spirit and scope. The present invention is therefore to be construed to cover the following exemplary embodiments.

Although, for example, the distance L from the tip of the corona electrode 21 to the tip of the sheath gas nozzle 4 is set at 1 mm or less in the above embodiment, it is non-limitative. That is, this distance may be freely set as long as the sheath gas can prevent impurities from the air within the clean room from depositing on the corona electrode 21 and as long as in the case of using the high-purity $N_2$ gas as the sheath gas, the electrons emitted from the negative corona electrode 21*b* can jump out of the sheath gas to ensure a generation of sufficient negative ions. Also in the case of using air as the sheath gas, that distance may be arbitrarily determined providing that the negative ions generated from the negative corona electrode 21*b* can rapidly disperse outside the sheath gas nozzle 4*b* without remaining in the interior of the sheath gas nozzle 4*b* to ensure a generation of sufficient negative ions.

Although the internal diameter of the sheath gas nozzle 4 and the external diameter of the corona electrode 21 are set at 5 mm and 2 mm, respectively, they are non-limitative and may be arbitrarily selected as long as sufficient increase in the sheath gas flow velocity can be achieved.

Although the above embodiment employs a vertically unidirectional flow type clean room for accommodating the sheath gas nozzle 4, it is non-limitative and any other production environment may be provided as long as there exists a flow carrying ions emitted from the sheath gas nozzle 4.

<Effect of the Invention>

In order to ensure a generation of sufficient negative ions, according to the present invention as described hereinbefore, the distance from the tip of the corona electrode to the tip of the nozzle is so determined that in the case of using as the sheath gas a gas containing no negative gaseous molecules, electrons emitted by corona discharge can reach the air existing outside the nozzle, and that in the case of using as the sheath gas a gas containing negative gaseous molecules, negative ions generated by the corona discharge can disperse into the air outside of the sheath nozzle without remaining in the interior of the sheath nozzle. Thus, the corona electrodes are sheathed with sheath gas containing no impurities or water (hydrogen), to thereby prevent the impurities from depositing on the corona electrodes and accomplish a full removal of static electricity from the production environment such as the clean room.

What is claimed is:

1. An air ionizing apparatus for generating positive or negative ions to eliminate static electricity, said apparatus comprising:

a pair of cylindrical nozzles;

a pair of needle-like corona electrodes respectively inserted into the interiors of said pair of nozzles associated therewith;

positive and negative high-voltage power sources respectively connected to said pair of corona electrodes for generating corona discharge; and gas supply means for supplying a nitrogen sheath gas into the interiors of said nozzles and causing the sheath gas to pass through the vicinity of said corona electrodes and flow out through the tips of said nozzles to the exteriors;

said corona electrodes being positioned within said associated nozzles in such a manner that the tips of said corona electrodes are retreated inwardly from the tips of said associated nozzles by a predetermined distance to provide a field angle defined between the tip and the nozzle of greater than 90 degrees;

said predetermined distance by which the tips of said corona electrodes are retreated from the tips of said associated nozzles is set at such a value that in the case of using as said sheath gas a gas containing no negative gaseous molecules with a flow rate of at least 0.5 m/sec, electrons emitted by said corona discharge and sent forth together with said sheath gas from said nozzle tips can reach air existing outside said nozzles.

2. An air ionizing apparatus according to claim 1, wherein said sheath gas is an inert gas.

3. An air ionizing apparatus according to claim 2, wherein the velocity of said sheath gas is so determined that a gas flow is engulfed into said nozzles in the vicinity of the tips of said nozzles.

4. An air ionizing apparatus according claim 1, wherein the velocity of said sheath gas is so determined that a gas flow is engulfed into said nozzles in the vicinity of the tips of said nozzles.

5. An air ionizing apparatus according to claim 4, wherein the velocity of said sheath gas is 1.0 m/sec. or over.

6. An air ionizing apparatus for generating positive or negative ions to eliminate static electricity, said apparatus comprising:

a pair of nozzles;

a pair of needle-like corona electrodes respectively inserted into the interiors of said pair of nozzles associated therewith;

positive and negative high-voltage power sources respectively connected to said pair of corona electrodes for generating corona discharge; and gas supply means for supplying a sheath gas into the interiors of said nozzles and causing the sheath gas to pass through the vicinity of said corona electrodes and flow out through the tips of said nozzles to the exteriors;

said corona electrodes being positioned within said associated nozzles in such a manner that the tips of said corona electrodes are retreated inwardly from the tips of said associated nozzles by a predetermined distance;

said predetermined distance by which the tips of said corona electrodes are retreated from the tips of said associated nozzles is set at such a value that in the case of using as said sheath gas a gas containing negative gaseous molecules, negative ions emitted by said corona discharge can rapidly disperse into the air existing outside said nozzles without remaining in said nozzles.

7. An air ionizing apparatus according to claim 6, wherein the velocity of said sheath gas is so determined that a gas flow is engulfed into said nozzles in the vicinity of the tips of said nozzles.

8. An air ionizing apparatus according to claim 6 wherein the inside diameter of each of said pair of nozzles and the outside diameter of each of said pair of corona electrodes are small enough to decrease the flow amount of said sheath gas and, at the same time, cause said sheath gas to flow speedily enough to prevent impurities from accumulating on the tips of the corona electrodes.

9. An air ionizing apparatus for generating positive or negative ions to eliminate static electricity, said apparatus comprising:

a pair of nozzles;

a pair of needle-like corona electrodes respectively inserted into the interiors of said pair of nozzles associated therewith;

positive and negative high-voltage power sources respectively connected to said pair of corona electrodes for generating corona discharges; and gas supply means for supplying a sheath gas into the interiors of said nozzles and causing the sheath gas to pass through the vicinity of said corona electrodes and flow out through the tips of said nozzles to the exteriors;

said corona electrodes being positioned within said associated nozzles in such a manner that the tips of said corona electrodes are retreated from the tips of said associated nozzles by a predetermined distance;

the inside diameter of each of said pair of nozzles being about 5 mm ϕ;

the outside diameter of each of said pair of electrodes being about 2 mm ϕ;

said predetermined distance by which the tips of said corona electrodes are retreated inwardly from the tips of said associated nozzles being set at 1 mm or less.

10. An air ionizing apparatus according to claim 9, wherein said sheath gas is an inert gas.

11. An air ionizing apparatus according to claim 9, wherein the velocity of said sheath gas is so determined that a gas flow is engulfed into said nozzles in the vicinity of the tips of said nozzles.

12. An air ionizing method for generating positive or negative ions to eliminate static electricity, said method comprising the steps of:

inserting a pair of needle-like corona electrodes respectively into the interiors of a pair of nozzles associated therewith, said pair of corona electrodes being respectively connected to positive and negative high-voltage power sources;

positioning said corona electrodes within the interiors of said associated nozzles in such a manner that the tips of said corona electrodes are retreated inwardly from the tips of said associated nozzles by a predetermined distance and in such a manner that when said sheath gas is a gas containing no negative gaseous molecules, the tips of said corona electrodes lie in close proximity to the tips of said associated nozzles so that electrons emitted by said corona discharge can reach air existing outside said nozzles;

supplying the sheath gas into the interiors of said nozzles and allowing said sheath gas to pass through the vicinity of said corona electrodes and flow out from the tips of said nozzles to the exteriors; and causing said sheath gas to send forth ions generated at said corona electrodes into the air existing outside said nozzles.

13. An air ionizing method for generating positive or negative ions to eliminate static electricity, said method comprising the steps of:

inserting a pair of needle-like corona electrodes respectively into the interiors of a pair of nozzles associated therewith, said pair of corona electrodes being respectively connected to positive and negative high-voltage power sources;

positioning said corona electrodes within the interiors of said associated nozzles in such a manner that the tips of said corona electrodes are retreated inwardly from the tips of said nozzles by a predetermined distance and in such a manner that when said sheath gas is a gas containing negative gaseous molecules, the tips of said corona electrodes lie in close proximity to the tips of said associated nozzles so that negative ions emitted by said corona discharge can rapidly disperse into the air existing outside said nozzles without remaining in the interiors of said nozzles;

supplying the sheath gas into the interiors of said nozzles and allowing said sheath gas to pass through the vicinity of said corona electrodes and flow out from the tips of said nozzles to the exteriors; and causing said sheath gas to send forth ions generated at said corona electrodes into the air existing outside said nozzles.

14. An air ionizing method for generating positive or negative ions to eliminate static electricity, said method comprising the steps of:

inserting a pair of needle-like corona electrodes respectively into the interiors of a pair of nozzles associated therewith, said pair of corona electrodes being respectively connected to positive and negative high-voltage power sources;

positioning said corona electrodes within the interiors of said associated nozzles in such a manner that the tips of said corona electrodes are retreated inwardly from the tips of said associated nozzles by a predetermined distance and in such a manner that said predetermined distance by which the tips of said corona electrodes are retreated inwardly from the tips of said nozzles is 1 mm or less;

supplying the sheath gas into the interiors of said nozzles and allowing said sheath gas to pass through the vicinity of said corona electrodes and flow out from the tips of said nozzles to the exteriors; and causing said sheath gas to send forth ions generated at said corona electrodes into the air existing outside said nozzles.

15. An air ionizing apparatus for generating positive or negative ions to eliminate static electricity, said apparatus comprising:

a pair of nozzles;

a pair of needle-like corona electrodes respectively inserted into the interiors of said pair of nozzles associated therewith;

positive and negative high-voltage power sources respectively connected to said pair of corona electrodes for generating corona discharges; and gas supply means for supplying a sheath gas into the interiors of said nozzles and causing the sheath gas to pass through the vicinity of said corona electrodes and flow out through the tips of said nozzles to the exteriors;

said corona electrodes being positioned within said associated nozzles in such a manner that the tips of said corona electrodes are retreated inwardly from the tips of said associated nozzles by a predetermined distance;

the tips of said corona electrodes being positioned near the tips of said nozzles so that, within a range of the purity level of said sheath gas to prevent impurities from being accumulated on the tips of said corona electrodes and in case said sheath gas does not contain negative gaseous molecules, electronics emitted by said corona discharge and sent forth together with said sheath gas from nozzle tips can reach air existing outside said nozzles.

16. An air ionizing apparatus according to claim 15 wherein the inside diameter of each of said pair of nozzles and the outside diameter of each of said pair of corona electrodes are small enough to decrease the flow amount of said sheath gas and, at the same time, cause said sheath gas to flow speedily enough to prevent impurities from accumulating on the tips of the corona electrodes.

17. An air ionizing apparatus for generating positive or negative ions to eliminate static electricity, said apparatus comprising:

a pair of nozzles;

a pair of needle-like corona electrodes respectively inserted into the interiors of said pair of nozzles associated therewith;

positive and negative high-voltage power sources respectively connected to said pair of corona electrodes for generating corona discharges; and gas supply means for supplying a sheath gas into the interiors of said nozzles and causing the sheath gas to pass through the vicinity of said corona electrodes and flow out through the tips of said nozzles to the exteriors;

said corona electrodes being positioned within said associated nozzles in such a manner that the tips of said corona electrodes are retreated inwardly from the tips of said associated nozzles by a predetermined distance;

the tips of said corona electrodes being positioned near the tips of said nozzles so that, within a range of the purity level of said sheath gas to prevent impurities from being accumulated on the tips of said corona electrodes and in case said sheath gas does contain negative gaseous molecules, negative ions emitted by said corona discharge can rapidly disperse into air existing outside said nozzles without remaining in said nozzles.

18. An air ionizing apparatus according to claim 17 wherein the inside diameter of each of said pair of nozzles and the outside diameter of each of said pair of corona electrodes are small enough to decrease the flow amount of said sheath gas and, at the same time, cause said sheath gas to flow speedily enough to prevent impurities from accumulating on the tips of the corona electrodes.

* * * * *